US005924626A

United States Patent [19]

Whitnell

[11] Patent Number: 5,924,626

[45] Date of Patent: Jul. 20, 1999

[54] CARTON WITH LOCKING LID

[75] Inventor: Simon Whitnell, Exton, Pa.

[73] Assignee: Dopaco, Inc., Exton, Pa.

[21] Appl. No.: 09/066,551

[22] Filed: Apr. 27, 1998

[51] Int. Cl.[6] ..... B65D 5/66

[52] U.S. Cl. ..... 229/128; 229/126; 229/150

[58] Field of Search ..... 229/126, 128, 229/130, 149, 150

[56] References Cited

U.S. PATENT DOCUMENTS

| | | | |
|---|---|---|---|
| 1,545,771 | 7/1925 | Hout | 229/150 |
| 2,349,238 | 5/1944 | Burre . | |
| 2,832,527 | 4/1958 | Bosche, Jr. | 229/149 |
| 2,984,401 | 5/1961 | Herkender | 229/126 |
| 2,984,410 | 5/1961 | Giacosa . | |
| 3,313,468 | 4/1967 | Ross | 229/126 |
| 3,485,433 | 12/1969 | Rapp | 229/150 |
| 3,623,650 | 11/1971 | Watts | 229/149 |
| 3,809,310 | 5/1974 | VanderLugt, Jr. . | |
| 4,690,321 | 9/1987 | Spaeth . | |
| 4,714,190 | 12/1987 | Morrocco | 229/126 |
| 4,763,832 | 8/1988 | Forbes, Jr. . | |
| 4,785,160 | 11/1988 | Hart . | |
| 4,903,431 | 2/1990 | Stoll . | |
| 4,951,865 | 8/1990 | Eisman . | |
| 5,226,588 | 7/1993 | Schramm et al. | 229/149 |
| 5,402,929 | 4/1995 | Ritter et al. . | |
| 5,458,270 | 10/1995 | Tsao . | |
| 5,603,450 | 2/1997 | Whitnell . | |

*Primary Examiner*—Gary E. Elkins
*Attorney, Agent, or Firm*—Dennison, Meserole, Scheiner & Schultz

[57] ABSTRACT

A lid integrally hinged to a carton rear wall and including an outwardly extending tongue on the forward edge thereof which, upon a closing of the lid over the carton mouth, forwardly flexes the forward carton wall. The forward carton wall has an integral locking flange along the upper edge thereof which rearwardly pivots to overlie the forward portion of the lid and which defines a keeper opening within the front wall to receive the lid tongue.

15 Claims, 2 Drawing Sheets

CARTON WITH LOCKING LID

BACKGROUND OF THE INVENTION

Folded paperboard containers or cartons have long been favored in the fast food industry as an inexpensive and environmentally desirable manner of packaging fast food for the temporary storage of food products as when purchased as a carry-out item.

Inasmuch as such cartons are normally intended for one-time use, and disposed of after the contents have been consumed, and as millions of such cartons are used and disposed of, there is a continuing effort to reduce the material required, simplify manufacture, reduce the manipulative steps to prepare such cartons for use, enhance the strength of the carton, provide a secure lock assembly which requires minimal manipulation, etc.

SUMMARY OF THE INVENTION

The goals or objects of the present invention are basically those discussed above with the invention being particularly concerned with the carton lid and a lid locking assembly, including the construction thereof and its relationship to the open end of the carton body.

The lock assembly is so formed as to require no pre-closure manipulation to position the components thereof, and is engageable in a positive manner against accidental release by the single expedient of folding a locking flange. Release of the lock assembly, notwithstanding the secure closure engagement thereof, is equally distinctive in requiring only a manual pivotal return movement of the locking flange.

Basically, the carton includes a carton body with opposed front and rear walls and opposed side walls with substantially coplanar upper edges. The lid, preferably planar, is integral with the upper edge of the rear wall along the length thereof and folds forwardly to overlie the mouth of the carton. The front edge of the lid includes a central integral coplanar projecting tongue which, upon a closing movement of the lid, extends forwardly beyond the vertical plane of the front wall. The upper edge of the front wall integrally mounts a locking flange preferably coextensive therewith and rearwardly pivotal relative thereto. The locking flange includes a coplanar depending lug formed from the upper edge portion of the front wall in alignment with the locking tongue on the lid whereby, upon a rearward folding of the locking flange, the lug pivots upwardly and forwardly to define an underlying keeper slot or opening sized to receive the locking tongue.

The locking tongue, forwardly projecting beyond the plane of the front wall, requires a slight forward flexing of the locking flange and upper portion of the front wall, which may be achieved automatically by a downward pressure on the lid, until the locking tongue aligns adjacent the upper edge of the front wall immediately below the flange. At that point, the locking flange is pivoted rearward to open the keeper opening and automatically receive the locking tongue. Thus, the single pivotal movement of the locking flange defines the keeper opening, automatically receives the locking tongue projecting through the keeper opening, positions the flange in overlying relation to the closed lid and positions the flange lug directly over the projecting locking tongue whereby the tongue precludes accidental pivotal release of the locking flange.

The closed lid preferably engages the upper edges of the side walls to align the locking tongue with the flange lug for a proper automatic engagement of the tongue through the defined keeper opening as the flange is rearwardly pivoted. In addition, engagement of the lid on the upper edges of the opposed sides stabilizes the lid and combines with the overlying flange to effectively retain the free edge of the lid.

Other details and features of the invention will become apparent from the more specific description of the invention following hereinafter.

DESCRIPTION OF PREFERRED EMBODIMENTS

Figure 1:
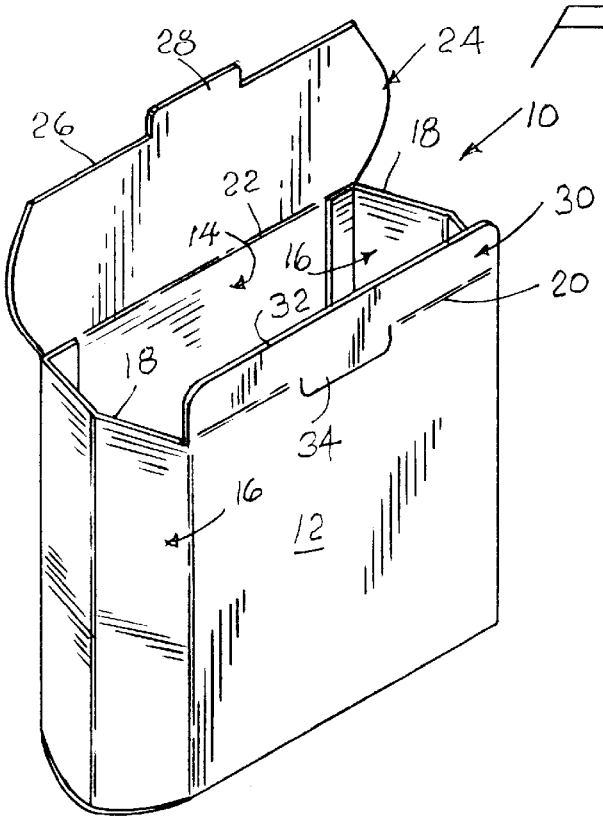
FIG. 1 is a perspective view of a carton in accord with the present invention with the lid open.
Figure 2:
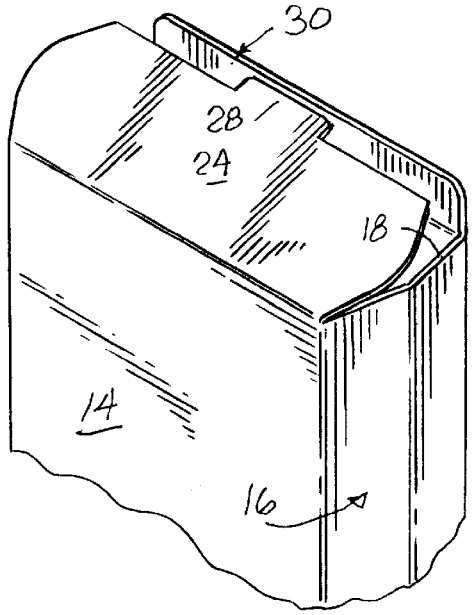
FIG. 2 is a perspective view with the lid in a partially forwardly pivoted position.
Figure 3:
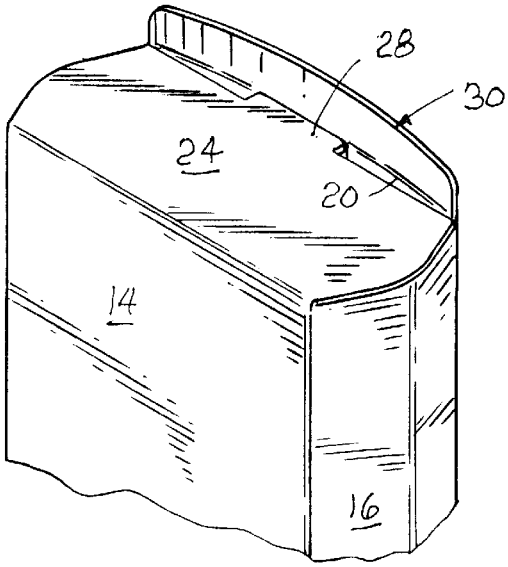
FIG. 3 is a perspective view with the lid in its closed position immediately prior to a folding of the locking flange.
Figure 4:
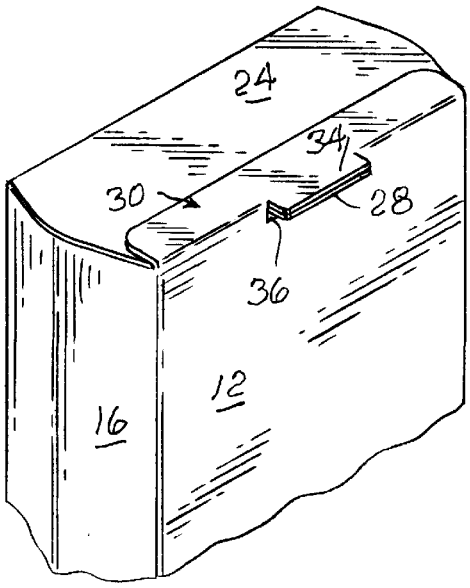
FIG. 4 is a perspective view with the locking flange pivoted to its locked position and with the locking tongue extended through the keeper opening.

Referring now more specifically to the drawings, the carton 10 of FIGS. 1–4 is a preformed carton either erected at the point of assembly and nested with duplicate cartons for storage and shipment, or in the nature of a folded carton requiring an expansion of the carton at the point of use. The carton body includes front and rear walls 12 and 14, preferably planar and parallel to each other, and opposed side walls 16. A bottom (not shown) of any conventional construction will also be provided. In those instances wherein the carton 10 will be collapsible for flat storage, the bottom will normally be of the self-erecting type.

The opposed side walls 16 have upper edges 18. The front wall has an upper edge 20 and the rear wall 14 has an upper edge 22. These upper edges 18, 20 and 22 are in a substantially common plane with the walls being of substantially equal height.

A planar lid is integral with the upper edge 22 of the rear wall 14 along the full length thereof with a hinge line formed therealong for a selective folding of the lid 24 between an open position coplanar with the rear wall 14 and a closed position overlying the mouth of the carton body defined by the upper edges of the carton walls. The lid 24 is of a slightly greater length than the distance between the opposed side walls 16 whereby upon a folding of the lid 24 to overlie the container mouth, the opposed end portions of the lid will seat on the upper edges 18 of the opposed side walls 16, thus properly positioning the lid. As noted in FIG. 1–4, the opposed ends of the lid 24 can be slightly rounded to generally conform to the slightly arcuate configuration of the opposed side walls 16.

The front or outer edge 26 of the lid 24 is preferably linear and parallels the upper edge 22 of the carton rear wall 14 along which the lid is hinged. The transverse width of the lid between the hinged inner edge thereof and the outer edge 26 is equal to or substantially equal to the transverse distance between the front and rear walls 12 and 14 of the carton body. A locking tongue 28 is integral and coplanar with the lid 24 and extends forwardly or outwardly from the outer edge 26, preferably centrally therealong. Inasmuch as the transverse width of the lid 24 corresponds to the transverse distance between the front and rear walls 12 and 14, the locking tongue 28 will, upon a forward and downward swinging of the lid, project forwardly beyond the front wall 12.

The locking assembly securing the lid 24 to the carton body, in addition to the locking tongue 28, includes a locking flange 30 integral with the front wall 12 along the upper edge 20 thereof and inwardly foldable relative thereto along an integral hinge defined along this upper edge 20. The flange 30 is preferably coextensive with the upper edge 20 of the front wall 12 and is of a height or transverse width between the upper wall edge 20 and the flange outer edge 32 which is less than one-half of the transverse width of the lid 24 or the distance between the front and rear walls of the erected carton.

The locking flange 30 includes an integral coplanar lug 34 defined from the upper portion of the front wall 12 immediately below the upper edge 20 thereof and transversely aligned with the lid locking tongue 28. The length of the lug 34 is slightly greater than that of the tongue 28 and of generally the same height. Upon a rearward and downward folding of the locking flange 30, the lug 34, remaining coplanar therewith, pivots forwardly and upwardly to a forwardly extending position as will be best seen in FIG. 4, and thereby defines a keeper opening 36 through the front wall 12 immediately below the upper edge 20 thereof.

In use, the carton 10 appears as in FIG. 1 at the time of introduction of the foodstuff or other goods to be retained therein. After the carton has been filled, and noting FIGS. 2 and 3, the lid is pivoted forwardly and, as the projecting locking tongue 28 engages the locking flange 30, this flange and the upper portion of the front wall 12 immediately therebelow, are forwardly bowed to allow for continued downward movement of the locking tongue 28 until the tongue aligns with the lug 34 and, preferably, the lid seats on the upper edges 18 of the opposed side walls 16. At that point, one need merely rearwardly pivot the locking flange 30, opening the keeper opening 36 and allowing for the locking tongue to pop therethrough. The released pressure on the flange and front wall allow for the wall to return to its original position through the inherent resilient flexibility of the paperboard or like material. In this position, noting FIG. 4 in particular, the locking tongue is substantially coextensive with and engaged immediately beneath the forwardly directed flange lug 34, thus retaining the lug 34 upwardly pivoted and the flange correspondingly downwardly pivoted into engagement over the forward portion of the lid 24. This interacting relationship between the locking tongue 28, flange 30 and lug 34 ensure a positive retention of the lid 24 in its closed and locked position. A positive manual forwardly and upwardly pivoting movement of the flange 30 is required to release the lid. Such a movement will effect a downward and rearward pivoting of the flange lug 34 which engages against the locking tongue 28 for a combined rearward movement of the lid and forward flexing of the flange and front wall until the tongue 28 clears the keeper opening 36, at which time the lid, through the inherent memory of the lid hinge, will pop upwardly at least sufficient to be easily grasped and opened by the consumer. Incidentally, with regard to this inherent tendency for the lid to pivot upward upon release, it will be appreciated that this inherent tendency, in the closed and locked lid of FIG. 4, will, through upward engagement of the tongue against the overlying flange lug, tend to further secure the lock assembly.

Figure 5:
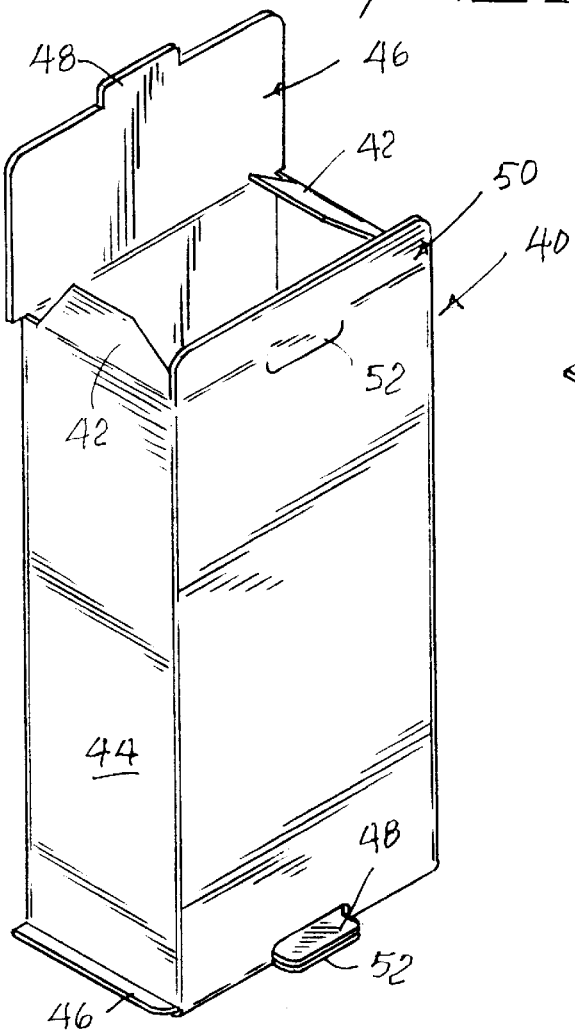
FIG. 5 is a perspective view of a carton with the mouth modified to incorporate opposed side wall flanges, and also illustrating the possibility of providing a duplicate lid and lock assembly on both ends of the carton body.
Figure 6:
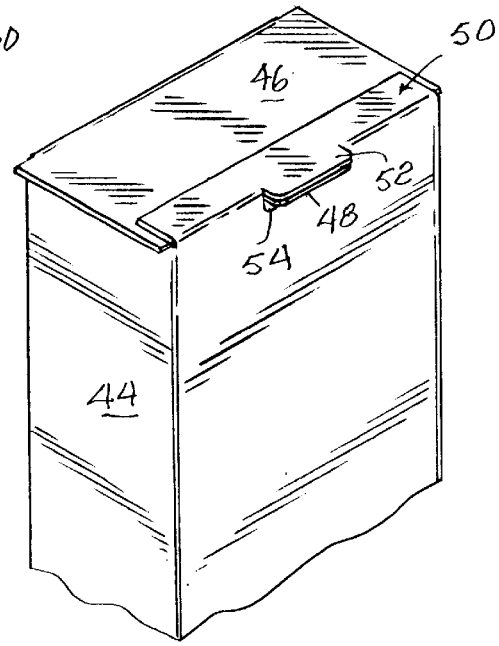
FIG. 6 is a perspective view of the upper portion of the carton of claim 5 with the lid closed and locked.

Turning now to the embodiment of FIGS. 5 and 6, the carton 40 therein differs from the carton 10 in several aspects, including the provision of inwardly folding integral flaps 42 on the straight upper edges of the opposed planar side walls 44. These flaps 42 are positioned to underlie the planar lid 46 and provide additional support therefor in the closed position of the lid as in FIG. 6. These flaps 42 will also, through an inherent tendency to upwardly unfold, also encourage an automatic elevating of the lid as the lock assembly is released. The lock assembly, including the locking tongue 48, locking flange 50, flange lug 52 and keeper opening 54 duplicate the corresponding components 28, 30, 34 and 36 in the first embodiment, and function in the same manner as previously described.

FIG. 5 is of further interest in illustrating the possibility of forming the bottom of the carton by utilizing the same lid and lock assembly construction as at the top of the carton 40 should such a ready release construction be desired at both ends of the carton.

Figure 7:
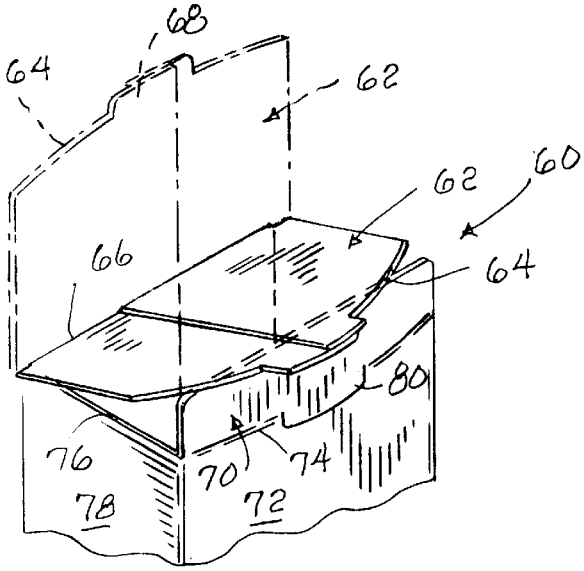
FIG. 7 is a perspective view of the upper portion of a carton with a modified lid illustrated, in phantom lines, in the fully open position, and in full lines in a forwardly pivoted position.
Figure 8:
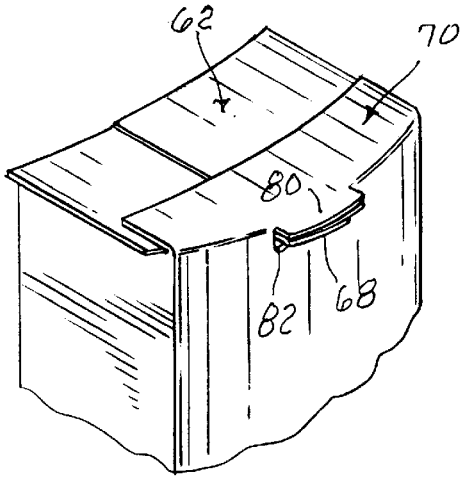
FIG. 8 illustrates the carton of FIG. 7 with the lid fully closed and locked.

FIGS. 7 and 8 illustrate, on carton 60, a further embodiment of a lid 62 and associated lock assembly. The lid 62 differs from the prior lids 24 and 46 principally in the convex or outwardly arcing configuration of the outer or front edge 64 thereof. Further, the width of the lid 62, between the hinged inner end thereof integral with the upper edge of the rear wall at 66 is, at the central portion of the arched edge 64, and preferably for the entire of the arched edge 64, slightly greater than the transverse width between the front and rear walls of the carton 60. As will be noted, the lid 62 also includes a coplanar outwardly extending locking tongue 68, preferably centrally along the outer edge 64 at the area of maximum lid width. Incidentally, as will be noted from the drawings, the edge joinder of the paperboard or sheet material forming the carton coincides with and extends transversely across the center of the lid 62 and the tongue 68, thus tending to provide additional rigidity and strength.

The locking flange 70 extends upwardly from the upper edge of the carton front wall 72 and is rearwardly foldable relative thereto along an upwardly directed slightly concave hinge line 74 defined at the integral joinder between the lower edge of the locking flange 70 and the upper edge of the front wall 72. The arcuity of the concave hinge line 74 extends from the opposed ends of the hinge line and depends below the common plane defined by the upper edges 76 of the side walls 78 and the upper edge 66 of the rear wall. The locking flange also includes a coplanar integral depending lug 80 defined from the upper portion of the front wall 72 immediately below the flange hinge line 74 and aligned with the locking tongue 68 so as to, as previously described, define a keeper opening 82 of a size so as to freely although closely receive the locking tongue 68 as the lid is closed and the lock assembly engaged.

Of particular interest with regard to the embodiment of FIGS. 7 and 8 is the extension of the arced outer edge portion of the lid beyond the plane of the front wall 72 and the locking flange 70, and the positioning of the keeper opening 82, in light of the concavity of the flange hinge line 74, below the support plane of the lid 62 as defined by the upper edges 76 of the side wall 78. Thus, as the lid 62 is moved to its closed position, engagement with the locking flange 70 will, through the inherent resilient flexibility of the material of the carton, cause this flange 70 and the upper portion of the carton front wall to forwardly flex to a greater degree than that produced in the earlier embodiments wherein the width of the lid substantially corresponds to the distance between the front and rear walls. Upon the lid 62 reaching its fully seated position on the upper edges 76 of the side wall 78, the locking flange 70 is rearwardly pivoted, opening the keeper opening 82 and allowing the locking tongue 68 to snap therethrough. As will be appreciated from FIG. 8, inasmuch as the keeper opening 82 will position the locking tongue 68 below the normal support level defined by the side wall upper edges 76, the closed lid 62 will assume a slight concave configuration following the locking flange hinge line 74. Similarly, in light of the concavity of the hinge line 74, the locking flange 70 itself will assume a concave configuration corresponding to and immediately overlying the forward portion of the lid 62.

Formed in this manner, there will be an increased upward biasing force to the lid 62 which enhances the intimate engagement between the lid and locking flange, and particularly the locking tongue 68 against the forwardly projecting lug 80 which, in conjunction with the concave configuration of the lid and flange, strengthens both the closure and the stability of the lock assembly. In light of the convex configuration of the outer edge 64 of the lid, the upper portion of the front wall 72 will retain a transverse arcuity corresponding to the arc of the lid edge 64 and gradually taper into a more planar configuration toward the lower end of the carton body.

As an aside, if the foodstuff to be received in the carton 60 consists of multiple small food items such as chicken nuggets, dough balls, and the like, the arcing of the front wall 72 as the lid 62 is closed, and the retention of the arced configuration in the closed carton could allow for a slight settling of the foodstuff within the carton as might facilitate the closing of the lid.

The release of the lid 62 is effected in the same manner as with regard to the previously described embodiments, and involves merely an upward and forward pivoting of the locking flange 70 which in turn effects a rearward push on the locking tongue 68 and a corresponding further forward flexing of the front wall 72 until the tongue springs free.

The foregoing is illustrative of the features of the invention. As additional embodiments incorporating such features may occur to those skilled in the art, it is intended that the invention be limited only by the scope of the claims following hereinafter.

I claim:

1. A carton formed of foldable sheet material, said carton comprising opposed front and rear walls, and opposed side walls, each of said walls having an upper edge, said upper edges defining a carton mouth, a lid having a rear edge integral with said upper edge of said rear wall and foldable forwardly relative to said rear wall to a closed position overlying said carton mouth, said lid having a front edge positionable adjacent said upper edge of said front wall in said closed position, a locking tongue integral and coplanar with said lid and extending forward from said lid front edge to project beyond said front wall in said closed position, a locking flange extending along said upper edge of said front wall, said locking flange having an inner edge integral with said upper edge of said front wall, said locking flange being foldable rearwardly about said upper edge of said front wall to overlie said lid in said closed position, a lug integral with and coplanar with said inner edge of said locking flange and defined from said front wall immediately below said upper edge of said front wall, said lug, upon a rearward pivoting of said locking flange, pivoting forwardly and upwardly away from said front wall wherein an opening is defined in said front wall immediately below said upper edge of said front wall for engagement of said locking tongue therethrough in said closed position of said lid.

2. The carton of claim 1 wherein said lid, in said closed position, overlies said upper edges of said side walls.

3. The carton of claim 2 where in said opposed front and rear walls are spaced at a predetermined distance, said front edge of said lid being convex, said lid having a maximum transverse width between said rear edge and front edge of said lid which is slightly greater than the distance between said front and rear walls wherein a slight outward bulging of said front wall is required in said closed position.

4. The carton of claim 3 wherein said upper edge of said front wall is concave wherein said lid in said closed position and said folded flange assume a concave configuration.

5. The carton of claim 2 wherein said tongue is located centrally along said front edge of said lid, and said opening is defined centrally along said front wall adjacent the upper edge thereof.

6. The carton of claim 2 wherein said carton includes lower wall edges defining a bottom mouth, and a duplicate lid and locking flange integral with said front and rear walls along the lower edges thereof and foldable to a closed position.

7. The carton of claim 2 wherein the upper edges of said side walls each include an inwardly folding closure flap integral therewith and positionable beneath said lid in said closed position.

8. The carton of claim 2 wherein said locking flange is coextensive with said upper edge of said front wall.

9. A carton formed of foldable sheet material, said carton comprising opposed front and rear walls laterally spaced at a predetermined distance, and opposed side walls, each of said walls having an upper edge, said upper edges defining a carton mouth, a lid having a rear edge integral with said upper edge of said rear wall, said lid having a front edge and a transverse width between said front and rear edges substantially equal to at least said distance between said front and rear walls, a locking tongue integral with said lid along said front edge and extending forwardly therefrom coplanar with said lid, a locking flange integral with and extending from said upper edge of said front wall, a hinge line defined between said locking flange and said front wall along said front wall upper edge, a lug integral and coplanar with said locking flange and defined from said front wall immediately below said upper edge of said front wall wherein upon a folding of said locking flange toward said rear wall, with the lug folding upwardly and forward of said front wall, a tongue-receiving opening is defined in said front wall immediately below said upper edge thereof.

10. The carton of claim 9 wherein said front edge of said lid is convex.

11. The carton of claim 10 wherein said upper edge of said front wall is concave.

12. The carton of claim 11 wherein said tongue is centrally positioned along said lid front edge, said defined opening being of a length sufficient as to receive said tongue therethrough.

13. The carton of claim 9 where in said tongue is centrally positioned along said lid front edge, said defined opening being of a length sufficient as to receive said tongue therethrough.

14. A carton formed of foldable sheet material, said carton comprising peripheral walls with upper edges defining a carton mouth, a lid integral with the upper edge of one of said peripheral walls and foldable thereabout to overlie said carton mouth, said lid having an outer edge positionable immediately adjacent the upper edge of a second of said peripheral walls, said lid outer edge having an integral, coplanar and outwardly projecting locking tongue on said outer edge thereof, a locking flange integral with said second of said peripheral walls along said upper edge thereof and foldable relative thereto to overlie said lid when positioned over said carton mouth, said locking flange including an integral coplanar lug defined from said second of said peripheral walls immediately below said upper edge thereof, said lug, upon a folding of said flange, defining an opening through said second peripheral wall immediately below said upper edge thereof and oriented to receive said locking tongue with said lid positioned over said carton mouth.

15. The carton of claim 14 wherein said tongue is centrally located along said front edge of said lid.

* * * * *